United States Patent [19]

Kogut

[11] Patent Number: 4,744,113

[45] Date of Patent: May 17, 1988

[54] TOILET TRAINING AID AND METHOD

[76] Inventor: Judy J. Kogut, 147 All Angels Hill Rd., Wappingers Falls, N.Y. 12590

[21] Appl. No.: 853,989

[22] Filed: Apr. 21, 1986

[51] Int. Cl.[4] ..... A47K 17/00; A47K 13/18; A47K 13/14

[52] U.S. Cl. ..... 4/661; 4/243; 4/242; 4/247; 428/29; 428/913; 434/328; 604/361

[58] Field of Search ..... 4/661, 314, 300.3, 300.1, 4/247, 243, 242, 244–246; 428/913, 29; 116/207; 434/247, 328; 604/361

[56] References Cited

U.S. PATENT DOCUMENTS

| | | | |
|---|---|---|---|
| 887,686 | 5/1908 | Morrison | 4/247 |
| 1,125,847 | 1/1915 | Humphrey | 4/247 |
| 1,601,088 | 9/1926 | Sullivan et al. | 4/247 |
| 1,863,499 | 6/1932 | Phillips | 4/247 |
| 1,866,545 | 7/1932 | Cohen | 434/328 |
| 2,944,664 | 7/1960 | Thomasma | 4/244 X |
| 3,753,262 | 8/1973 | Watsky | 4/247 X |
| 3,826,499 | 7/1974 | Lenkoff | 434/328 X |
| 4,022,211 | 5/1977 | Timmons et al. | 604/361 |
| 4,044,405 | 8/1977 | Kriss | 4/661 |
| 4,327,731 | 5/1982 | Powell | 604/361 |
| 4,360,548 | 11/1982 | Skee et al. | 428/29 |

FOREIGN PATENT DOCUMENTS

| | | | |
|---|---|---|---|
| 2240957 | 2/1974 | Fed. Rep. of Germany | 4/661 |

*Primary Examiner*—Henry K. Artis

*Attorney, Agent, or Firm*—Harry M. Weiss & Associates

[57] ABSTRACT

A toilet training aid comprising a porous sheet of papers having a normally invisible picture imprinted thereon is attached to the rim of a toilet bowl over the mouth thereof whereby the attention of a child is attracted to use the toilet as the picture becomes visible when wetted by the urine of the child using the toilet.

6 Claims, 1 Drawing Sheet

TOILET TRAINING AID AND METHOD

BACKGROUND OF THE INVENTION

The present invention relates to training aids in general and, more particularly, to a toilet training aid and method of training infants to properly use a toilet.

It is highly desirable to reduce the time that it takes to normally train small children to properly use a toilet. A method of reducing training time should be to attract the attention of the child to the toilet to urinate therein. It is also desirable that such method include a training aid that attracts the child's attention while urinating in the toilet and which is easily disposed of after the child has used the toilet. Moreover, it is further desirable that such training aid be easily taken on trips so that the child's training is not disrupted.

Hence, a need exists for a bio-degradable and disposable toilet training aid to attract the attention of a child to the use of a toilet to therefore reduce the training time to teach the child to use a toilet.

SUMMARY OF THE INVENTION

Accordingly, it is an object of the present invention to provide an improved toilet training aid.

Another object of the present invention is to provide an improved method for toilet training children.

Still another object of the present invention is to provide an improved toilet training aid that is disposable and bio-degradable.

Yet another object of the present invention is to provide an improved disposable toilet training aid that can be carried on a person during trips away from home.

In accordance with the above and other objects there is provided a toilet training aid comprising a sheet of liquid permeable, porous paper having a normally invisible picture imprinted thereon which becomes visible by becoming wetted by, for example, the urine of a urinating child and means for attaching the sheet of paper over the toilet bowl.

The foregoing and other objects, features and advantages of this invention will be apparent from the following more particular description of the preferred embodiments of this invention, as illustrated in the accompanying drawings.

DETAILED DESCRIPTION OF THE PREFERRED EMBODIMENT

Figure 1:
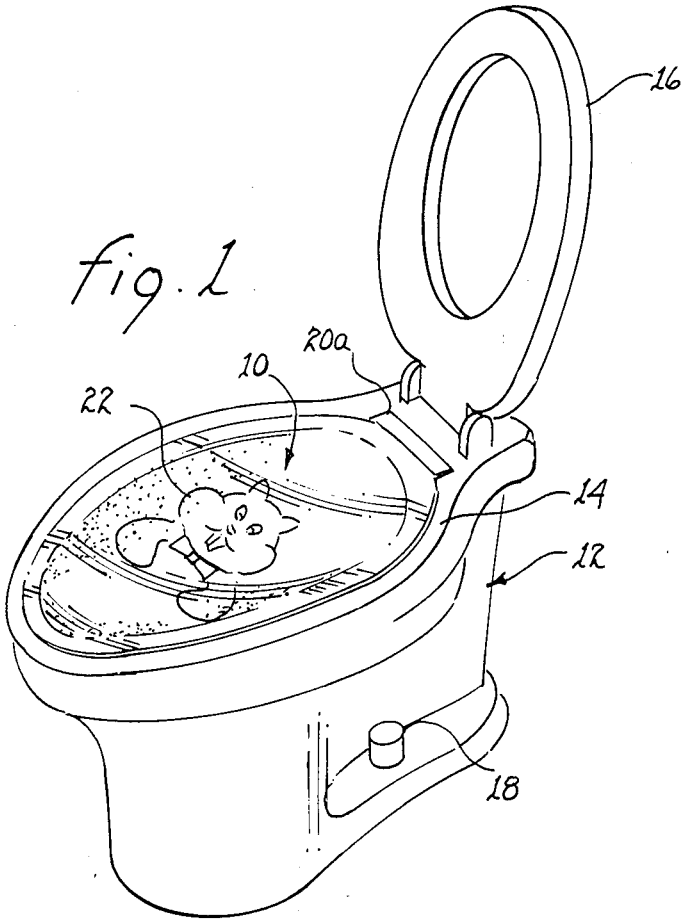
FIG. 1 is a perspective view of the toilet training aid fixed in place over a conventional toilet bowl.
Figure 2:
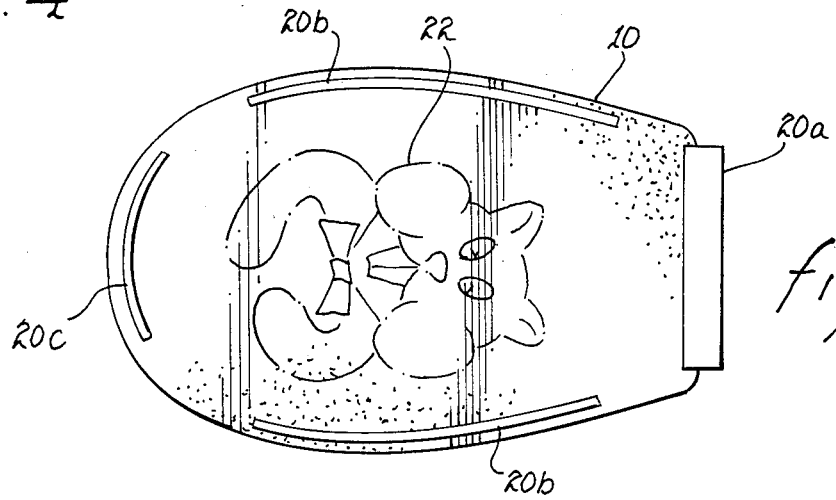
FIG. 2 is a top elevational view illustrating the toilet training aid of the preferred embodiment.

FIGS. 1 and 2 show training aid 10 of the present invention. Training aid 10 is fabricated to fit over the mouth of toilet bowl 12. Toilet bowl 12 is conventional in structure and includes a rim 14 to which training aid 10 is attached when toilet seat 16 is in a raised position as shown. Toilet bowl 12 is mounted to the floor as is understood using mounting means 18. As more particularly illustrated in FIG. 2, training aid 10 includes a plurality of self-adhesive elongated tabs **20*a* and 20*b*** affixed at the back portion and two sides thereof; as well as self-adhesive elongated tab **20*c* at the front portion thereof. Training aid 10 is formed of a sheet of porous, bio-degradable disposable paper that can be flushed down the toilet after use. As shown, training aid 10 is attached by self-adhesive tabs 20*a* and 20*b* to rim 14**.

Training aid 10 is imprinted with a color picture 22 which is normally invisible as indicated by being drawing in dashed outline form in FIG. 2. However, when a child urinates upon the liquid permeable paper sheet comprising training aid 10, color picture 22 (FIG. 1) appears as the urine permeates the porous paper. In this matter, the child's attention is attracted to the toilet which reduces the time it takes to normally toilet train an infant.

Figure 4:
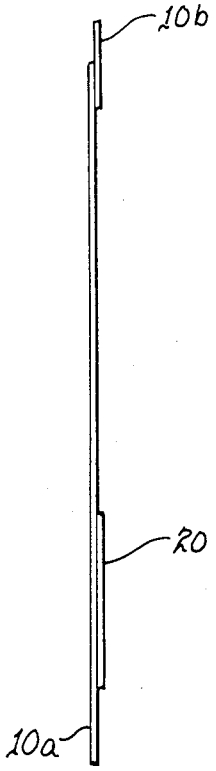
FIG. 4 is a side elevational view illustrating a portion of the roll shown in FIG. 3.
Figure 3:
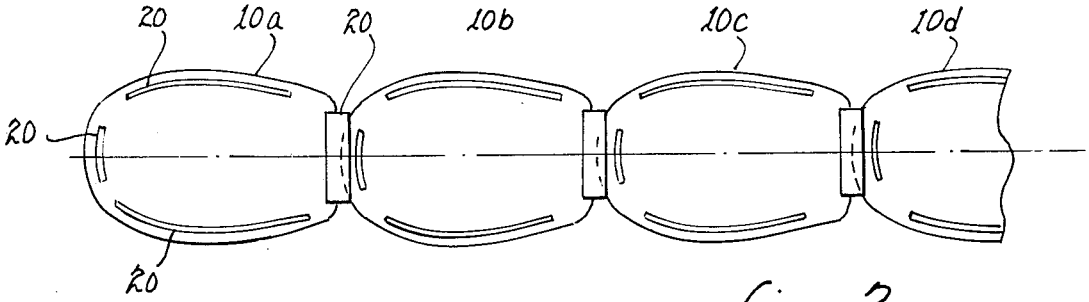
FIG. 3 is a top elevational view illustrating a plurality of the toilet training aids of FIG. 2 detachably attached in a roll.

FIGS. 3 and 4 show that toilet training aid 10 is detachable from a plurality of the like and separately detachable sheets **10*a*, 10*b*, 10*c*, 10*d*, etc. As understood the plurality of attached sheets of training aid 10 may be formed into a roll to be dispersed from a container similar in manner as aluminum sheets are detached from an aluminum foil container, for example. As illustrated, sheet or training aid 10*a* is attached to the next sheet 10*b*, and so forth, by self-adhesive tab 20*a* of the top sheet 10*a* making contact with the latter bottom sheet using a wax surface backing material on the front of the underlying sheet. Paper sheets 10*a*, 10*b***, etc. may also be packed into a dispensing package having a pocket for holding the same so that the training aid of the present invention can be taken on trips away from the home without disrupting the uniformity of the child's toilet training.

Hence, what has been described above is a novel children's toilet training aid comprising a porous sheet of paper having a color picture that is made visible by having the child urinate upon. This attracts the attention of the child to reduce the time to toilet train the child.

While the invention has been particularly shown and described in reference to preferred embodiments thereof, it will be understood by those skilled in the art that changes in form and details may be made without departing from the spirit and scope of the invention.

I claim:

1. A training aid for use with a toilet, comprising:

a disposable sheet of liquid permeable, porous paper having means for liquid activated viewing and for permitting visual observation of a normally latent graphic design therein that is not visible when said sheet is dry and is only visible when said sheet is wet, said sheet having a size and shape to fit over the mouth of said toilet; and means for attaching said sheet of paper over the mouth of the toilet bowl to the rim thereof such that said sheet becomes wetted by a child urinating thereon wherein said graphic design becomes visible thereby attracting the attention of the child, said disposable sheet of liquid permeable, porous paper having sufficient porosity to permit the passage of liquid urine therethrough while maintaining sufficient integrity to permit visible observation of said graphic design.

2. The training aid of claim 1 wherein said porous sheet of papers is bio-degradable.

3. The training aid of claim 1 wherein said attaching means includes a plurality of self-adhesive tabs affixed about the circumference of said sheet of papers.

4. The training aid of claim 3 wherein said plurality of self-adhesive tabs includes front and first and second elongated tabs fixed to the side portion so that said sheet of papers and a back elongated tab fixed to the back portion of said sheet of papers.

5. The training aid of claim 4 wherein said sheet of porous papers is detachably attached to at least one other like sheet.

6. Method of aiding in toilet training a child to use a toilet, the toilet having a bowl and a rim formed about the bowl, comprising the step of affixing a disposable, liquid permeable, porous sheet of paper to said rim of said toilet bowl wherein said paper is wetted by a urinating child such that a normally latent graphic design in said sheet of paper becomes visible, said disposable sheet of liquid permeable, porous paper having sufficient porosity to permit the passage of liquid urine therethrough while maintaining sufficient integrity to permit visible observation of said graphic design, said sheet having a size and shape to fit over the mouth of said toilet.

* * * * *